United States Patent [19]

Göbel

[11] 4,070,738

[45] Jan. 31, 1978

[54] FELTING APPARATUS

[75] Inventor: Volker Göbel, Alsfeld, Germany

[73] Assignee: Krafft Göbel KG Textilmaschinenbau, Alsfeld, Germany

[21] Appl. No.: 593,980

[22] Filed: July 8, 1975

[30] Foreign Application Priority Data

July 12, 1974 Germany ..... 2433602

[51] Int. Cl.[2] ..... D04H 17/12

[52] U.S. Cl. ..... 28/137; 26/19

[58] Field of Search ..... 28/5, 14, 72.3; 26/19, 26/20; 38/44, 49

[56] References Cited

U.S. PATENT DOCUMENTS

| | | | |
|---|---|---|---|
| Re. 199 | 5/1851 | Williams | 28/5 |
| 1,897 | 12/1840 | Williams | 28/5 |
| 87,763 | 3/1869 | Eickemeyer | 28/5 |
| 548,183 | 10/1895 | Coa | 28/5 |
| 2,263,712 | 11/1941 | Wrigley et al. | 38/44 X |
| 2,293,223 | 8/1942 | Street | 28/5 |
| 2,508,968 | 5/1950 | Porritt | 28/14 |
| 2,636,248 | 4/1953 | Lee, Jr. | 28/72.3 X |
| 2,708,303 | 5/1955 | Walton et al. | 28/72.3 X |
| 3,325,875 | 6/1967 | Göbel et al. | 28/5 |

*Primary Examiner*—Robert R. Mackey

*Attorney, Agent, or Firm*—Toren, McGeady and Stanger

[57] ABSTRACT

A felting apparatus having an upper and a lower row of driven rollers and including compression beams intermediate any two adjacent rollers in each row whereby the compression beams in one row may be disposed opposite corresponding compression beams or opposite rollers in the other row and define together with the opposing member tapered entry apertures for the material being processed The compression beams and/or the rollers in both rows may be spring-biased, include heating means and be adapted to be axially reciprocated by driving means.

11 Claims, 9 Drawing Figures

FELTING APPARATUS

The present invention relates to an apparatus for felting which is particularly suitable for the felting of felt materials. The apparatus includes a plurality of rollers that are arranged in two mutually overlying rows of rollers and associated driving means for rotating the rollers. Optionally may be provided means for axially reciprocating the rollers by variable predetermined amplitudes.

By the operation of fulling or felting, woolen fabrics are releaved from stresses and felted or matted, or in the wool felt production, the interlocking or felting of semi-matted felt materials is enhanced.

In the felting of felt materials, the process of interlocking initiated by felting is continued by applying mechanical forces and employing a felting fluid. The purpose of felting is to increase the density and hardness of the felt materials and to thereby increase the stability of the felts.

For the felting of felt materials are conventionally used hammer type fulling mills as well as cylinder and roller fulling machines.

In a heretofore known roller fulling machine for the felting of wool felts, the felt web is moved through a roller system consisting of upper and lower rollers whereby each upper roller is resiliently urged toward a corresponding lower roller or respectively toward the intermediate felt web. Preferably, the felt web is in the form of a continuous loop which runs several times through the machine. In this known roller felting machine some of the upper rollers and/or some of the lower rollers are of a cylindrical configuration, i.e. the outer diameters of the rollers are constant throughout their length. The remaining upper and/or lower rollers are of a non-cylindrical configuration, i.e. the rollers are tapered toward their ends. The rollers may have a cambered or crowned configuration, with a symmetrical or an asymmetrical crowning.

It is now the object of the present invention to provide an apparatus for felting which is particularly suitable for the felting of felt materials.

It is another object of the invention to provide a felting apparatus that may be manufactured at lower costs, is of minimum dimensions, takes up very little space when installed, and provides for a high output capacity with relatively simple technical means. The apparatus should also be suitable for felting fleeces of any desired thickness.

In accordance with the present invention there is now proposed an apparatus for felting which is particularly suitable for the felting of felt materials and includes a plurality of rollers arranged in two mutually overlying rows of rollers, driving means for rotating these rollers and, optionally, means for axially reciprocating these rollers wherein the amplitude of this reciprocating movement may be altered. This apparatus is characterized in that a. each roller in one of the two overlying rows of rollers is opposite a corresponding roller in the other row of rollers, or b. all of the rollers in upper row of rollers are laterally displaced with respect to the rollers in the lower row of rollers;

and that intermediate every two adjacent rollers in the upper and in the lower row of rollers is arranged a compression beam, the longitudinal extension of the compression beam corresponding substantially to the length of the rollers, each compression beam including, on its side facing a fleece being advanced along the clearance between the two rows of rollers, an arcuate surface, these arcuate beam surfaces defining entry apertures facing in the feed direction of a fleece together with a. opposing surface portions of rollers in the opposing row of rollers, or b. with corresponding surfaces of opposing compression beams.

In accordance with another characteristic of the present invention, the compression beams of the upper and lower rows of rollers are coupled to driving means for axially reciprocating the compression beams by variable predetermined amplitudes. The driving means for axially reciprocating the compression beams by variable predetermined amplitudes may be coupled to the means for axially reciprocating the rollers by variable predetermined amplitudes so as to provide synchronous movements.

According to one embodiment, every compression beam may consist of a rectangular profile and include a cantilevered portion with an arcuate surface at the side facing a fleece, the cantilevered portion projecting toward the entry side of the fleece. In another embodiment, every compression beam consists of a hollow profile of a substantially rectangular cross-section with arcuately shaped concave side walls of a curvature mating the curvature of the cylindrical outer surface of the rollers, and arcuately shaped convex top and bottom walls.

The invention will be described in the following with reference to the appended drawings wherein FIG. 1 is a fragmentary lateral view, partly in elevation and partly in section, of the feed end of a felting apparatus including two rows of rollers and compression beams disposed intermediate every two adjacent rollers, in accordance with the present invention;

The felting apparatus of the present invention preferably includes two rows of rollers that are journalled in a machine frame 5. The rollers may consist of hollow cylinders or be of any other suitable configuration.

Figure 1:
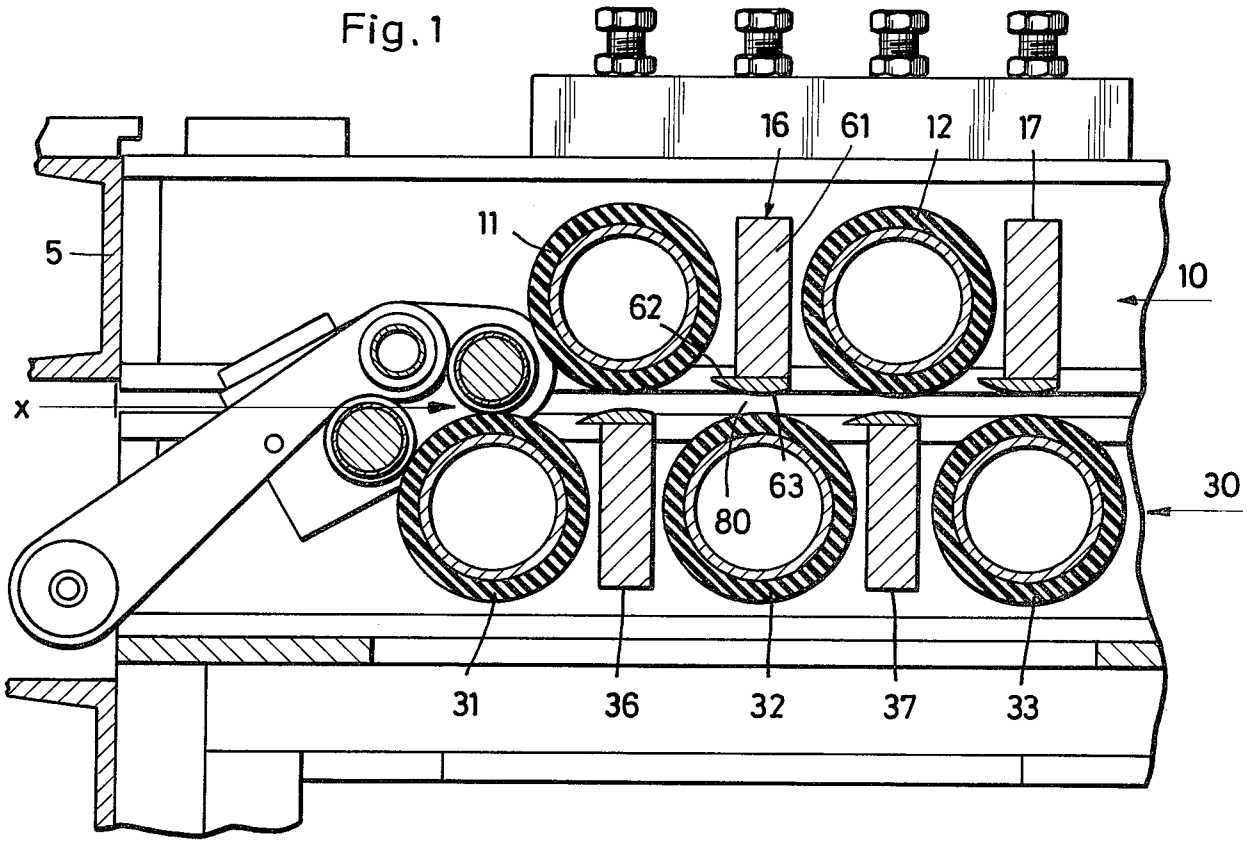
Figure 3:
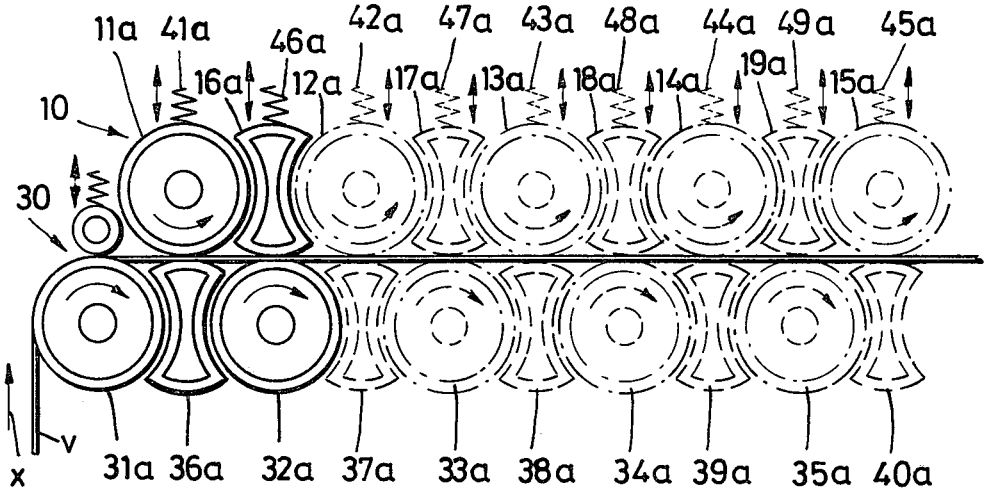
FIG. 3 is a schematic lateral elevational view of a felting machine with two rows of rollers whereby the rollers in the upper row are laterally displaced with respect to the rollers in the lower row of rollers.
Figure 4:
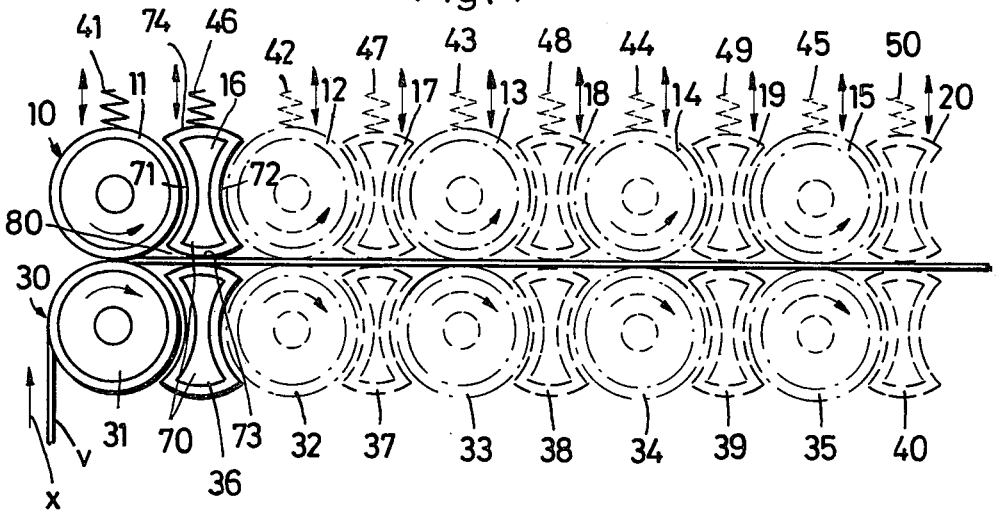
FIG. 4 is a schematic lateral elevational view of another embodiment of the felting machine, with upper and lower rows of rollers whereby the rollers and the intermediate compression beams in both rows respectively oppose each other.

In the embodiments shown in FIGS. 1, 3 and 4, the upper row of rollers is designated by the reference numeral 10, and the lower row of rollers is designated by the reference numeral 30. The number of rollers in both rows of rollers 10 and 30 may be selected freely. In the embodiment shown in FIG. 1, the upper row 10 includes two rollers, and the lower row 30 includes three rollers. In the embodiment of FIG. 4, the upper row of rollers 10 includes the rollers 11 through 15, and the lower row 30 includes the rollers 31 through 35. In the embodiment of FIG. 3, the upper row 10 includes the rollers 11*a* through 15*a*, and the lower row of rollers includes the rollers 31*a* through 35*a*. The two embodiments of FIGS. 3 and 4 differ insofar as in the embodiment of FIG. 4, the rollers 11 through 15 of the upper row 10 are each opposite a corresponding roller 31 through 35, respectively, of the lower row of rollers 30 whereas in the embodiment of FIG. 3, the rollers 11*a* through 15*a* of the upper row 10 are each laterally displaced with respect to the corresponding rollers 31*a* through 35*a* of the lower row of rollers 30.

In all of the embodiments shown in the drawings, the feed direction of a fleece V is indicated by the arrow X. The fleece V is advanced along the clearance or working gap between the two rows of rollers 10 and 30.

Figure 2:
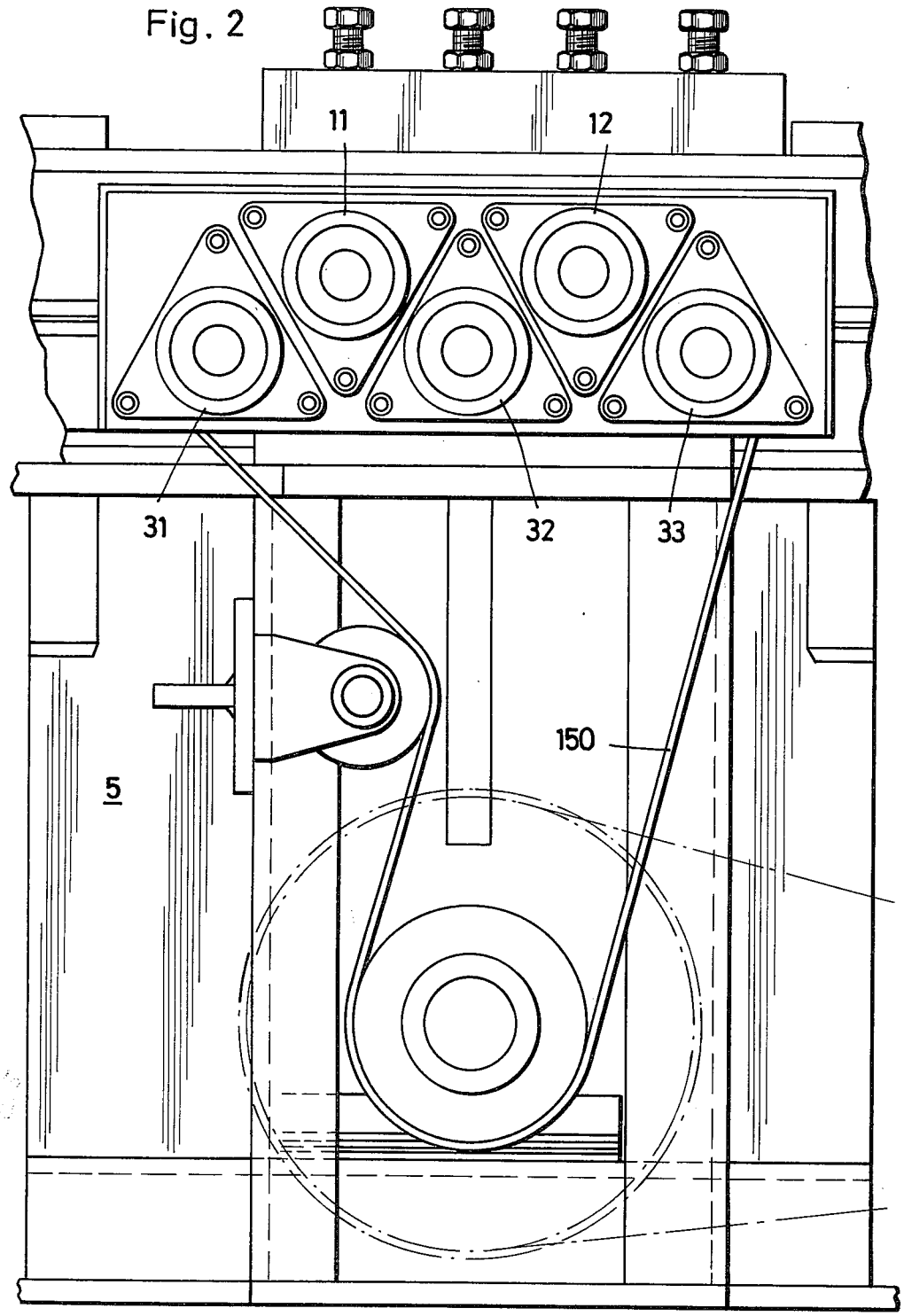
FIG. 2 is a fragmentary lateral elevational view of the felting machine showing schematically the driving means for rotating the rollers.

As may be seen in FIGS. 3 and 4, the rollers 11 through 15 or respectively, the rollers 11*a* through 15*a* of the upper row of rollers 10 are biased by springs 41 through 45 or 41*a* through 45*a*, respectively, which springs bias the rollers against the fleece V in between the rows of rollers or against the opposite rollers, i.e. against the rollers in the lower row of rollers. The driving means for rotating the rollers 11 through 15, 31 through 35 and 11*a* through 15*a* as well as 31*a* through 35*a* consist of a schematically shown conventional drive mechanism 150 (FIG. 2). All of the rollers may be driven.

A compression beam is arranged intermediate every two adjacent rollers in the upper and lower rows of rollers 10 and 30, respectively. The compression beams arranged intermediate the rollers 11 through 15 of the upper row of rollers 10 are designated by 16 through 20, and the compression beams intermediate the rollers 31 through 35 of the lower row of rollers 30 by 36 through 40, respectively (FIG. 4). In the embodiment shown in FIG. 3, the compression beams are designated by 16*a* through 19*a* and 36*a* through 40*a*, respectively. The compression beams 16 through 20 or 16*a* through 19*a* respectively disposed intermediate the rollers 11 through 15 or 11*a* through 15*a* of the upper row of rollers 10 are likewise biased by springs 46 through 50 and 46*a* through 49*a*, respectively, in the same manner as the rollers 11 through 15 and 11*a* through 15*a*. Since the rollers 11 through 15 of the upper row of rollers 10 are opposite the rollers 31 through 35 in the lower row of rollers 30, the compression beams 16 through 20 of the upper row of rollers 10 likewise oppose the corresponding compression beams 36 through 40 in the lower row of rollers 30 (FIG. 4). In the laterally displaced arrangement of the rollers 11*a* through 15*a* of the upper row of rollers 10 with respect to the rollers 31*a* through 35*a* of the lower row of rollers 30, as shown in the embodiment of FIG. 3, every compression beam is disposed opposite a roller.

In the embodiment of FIG. 1 every compression beam consists of a rectangular profile 61 as illustrated in the compression beam 16. At its side facing the fleece V, the compression beam 16 includes a cantilevered portion 62 projecting toward the entry side X, and the surface 63 of the cantilevered portion facing the fleece V is of an arcuate configuration. The shape of the surface 63 of the compression beam 16 is selected so as to define, together with an opposing surface portion of the opposing roller, a funnel-shaped entry aperture 80 which flares outwardly toward the entry side X and into which may be introduced the advancing fleece V.

In the embodiments of FIGS. 3 and 4, the compression beams consist of hollow profiles. All compression beams are identical. The configuration of these identical compression beams will be described more in detail with reference to the compression beam 16 in FIG. 4. The hollow profile 70 of the compression beam 16 is of a substantially rectangular cross-section. The lateral side walls 71 and 72 facing the adjacent rollers are arcuately shaped and define concave curvatures mating the curvature of the cylindrical outer surface of the adjacent rollers so that these rollers may be disposed at small clearances from the compression beam. The narrow top and bottom walls 73 and 74, respectively, of the compression beam are arcuately shaped, with a convex outer curvature. The cross-section of the bottom surface 73 is similar to the cross-sectional configuration of the surface 63 of the compression beam 16 of FIG. 1. The bottom surface 73 of the compression beam 16 defines together with the surface of the opposing compression beam likewise an entry aperture 80 for the fleece V (c.f. FIG. 4).

The length of the compression beams 16 through 20, 36 through 40 and 16*a* through 19*a* and 36*a* through 40*a* corresponds substantially to the length of the rollers 11 through 15, 31 through 35, 11*a* through 15*a* and 31*a* through 35*a*, respectively.

The rollers of the upper row of rollers 10 and of the lower row of rollers 30 as well as the compression beams may be coupled to driving means for axially reciprocating the rollers and/or compression beams. Details of this driving means are shown in FIG. 6.

Figure 5:
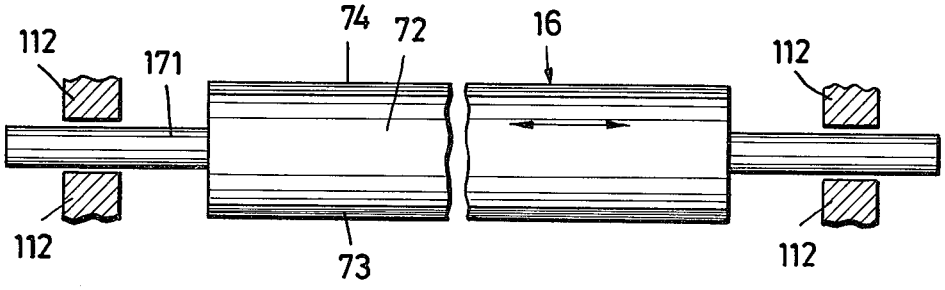
FIG. 5 is a sectional lateral elevational view of a compression beam.

As may be seen in FIG. 5, the compression beam 16 is mounted eccentrically on a shaft 171 which is journalled in bearings 112 in a machine frame, not shown. The reciprocal movement of the compression beam 16 or of a similarly mounted roller 11 is effected by a drive mechanism 150 (FIGS. 2 and 6). It is to be understood that the drive mechanism shown in FIG. 6 may be utilized to reciprocally drive either a compression beam or a roller. However, only the rollers are to have rotative movement imparted thereto. Further details of the drive mechanism of the invention may be obtained from U.S. Pat. No. 3,325,876, the disclosure of which is incorporated herein by reference.

Figure 6:
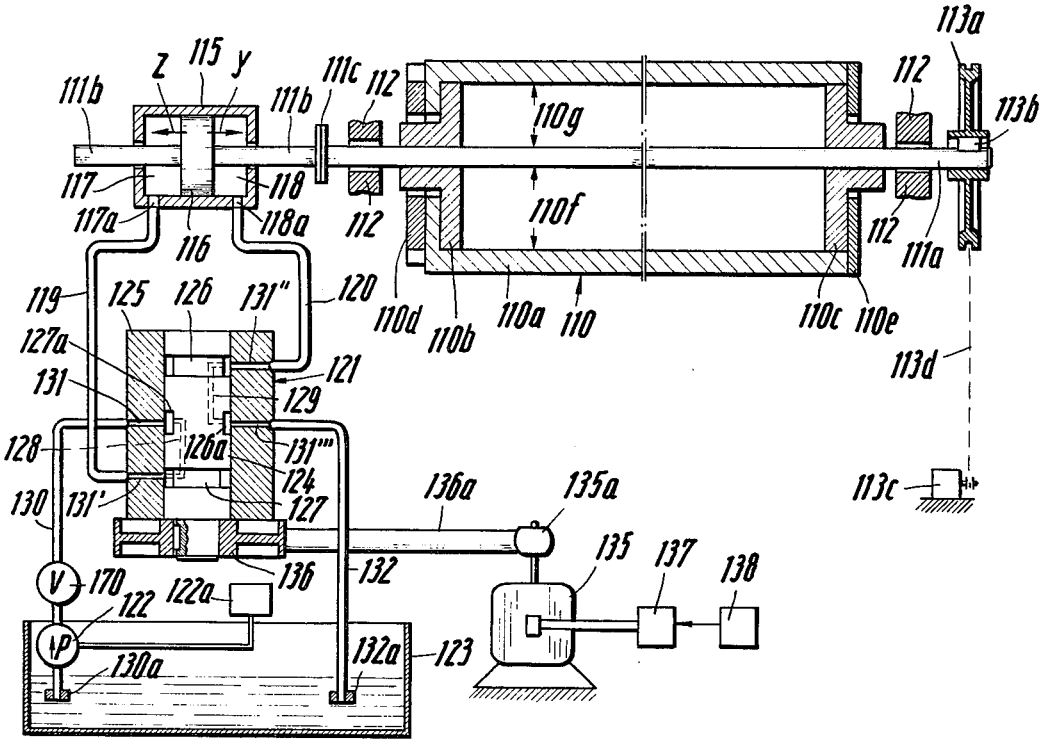
FIG. 6 is a fragmentary longitudinal cross-section through a roller of the felting machine, through driving means to axially reciprocate the roller, and through a device to control the driving means.

Referring to FIG. 6, the reference numeral 110 designates a roller of the type used in the felting apparatus and representative of the plurality of rollers used therein. In the actual felting machine, there is preferably an upper and a lower row, as pointed out above, each row being formed of such rollers 110, the fiber material being passed through the working gap between the two substantially parallel rows. In a practical situation, one row could consist of an odd number of rollers, for instance seven rollers, whereas the second row would correspondingly comprise an even number of rollers, for example, six or eight rollers. To achieve a high degree of efficiency, the rollers of one row can be displaced in the longitudinal direction of the rows relative to the rollers of the other row so that all rollers of one row are arranged in the middle between two adjacent rollers of the opposite row, rollers of one row actually meshing with rollers of the other row.

The individual rollers are supported at small distances from each other in the machine frame which is indicated here only by fragmentary illustrations of the bearings 112. All rollers are normally driven by one common mechanism, but each roller can be driven individually as well.

Roller 110 principally consists of a cylindrical drum-like or sleeve-like member 110*a*. Drum member 110*a* is fixedly mounted on a shaft 111*a* by means of discs 110*b* and 110*c*. Plates 110*d* and 110*e* close the assembly at both ends. Portions of shaft 111*a* protruding beyond drum member 110*a* are supported by bearings 112 at opposite sides of roller 110. A pulley 113*a* is positively fastened to one end of shaft 111*a* by means of a wedge 113*b*. A stationary electric motor 113*c* or another appropriate driving means is capable of rotating shaft 111*a* through a belt 113*d*. Dashed lines extending transversely to the longitudinal axis of shaft 111*a* indicate that roller 110 is actually longer in comparison with its diameter than represented by the drawing.

According to a preferred embodiment of this invention the cylindrical drum member 110*a* is not mounted coaxially with shaft 111*a* but in an eccentric manner to establish different length radii of rotation, 110*g* and 110*f*, about shaft 111*a*. In this manner vertical oscillations of the roller surface are obtained when roller 110 rotates with shaft 111*a*.

At its left hand, shaft 111*a* is connected with a second shaft portion 111*b* through a coupling 111*c*. Shaft portion 111*b* extends through a stationary housing 115 and mounts a double-acting piston 116. The outer peripheral surface of piston 116 sealingly engages the axial wall portion of housing 115 thereby dividing it into a first and a second chamber 117 and 118. Through port-holes 117*a* and 118*a* an appropriate fluid may alternatively be fed into chambers 117 and 118 forcing fluid through port-holes 118*a* or 117*a* out of chamber 118 or 117, respectively, when piston 116 is moved in direction of arrow Y or Z. Consequently, in accordance with the rhythm of the flow reversal, piston 116 performs a reciprocal movement due to which the desired reciprocal axial movement of roller 110 is accomplished.

A container 123 is provided for retaining a fluid for the operation of piston 116. A supply conduit 130 having the intake 130*a* communicates with the interior of container 123 and can be connected through a control unit, to be described later on, selectively to one of two conduits 119, 120, which, in turn, connect with chambers 117, 118, respectively. A back flow conduit 132 having the outlet 132*a* likewise communicates with the interior of container 123 and through the before-mentioned control unit with either chamber 117 or 118, by means of conduits 119, 120, respectively. The control unit is so designed that, in one position thereof, supply conduit 130 communicates exclusively with chamber 117 whereas back flow conduit 132 connects exclusively with chamber 118, or vice versa. A pump 122 is interconnected into supply conduit 130 to force the fluid from container 123 through conduit 130 into either chamber 117 or 118 depending on the position of the control unit, and correspondingly to move roller 110 in the direction of arrow Y or Z, respectively. The pressure fluid can be gaslike or a liquid such as oil, and the affected elements as container 123, conduit, housing-piston assembly, control unit, will be designed accordingly, depending on the type of fluid actually used. Instead of pump 122 a blower would be used for pressurizing and delivering a gaslike fluid.

The control unit, generally designated as 121, comprises a cylindrical housing 125 wherein a control cylinder 124 is sealingly and rotatably mounted. As annular groove 126 extends along the periphery of cylinder 124 in the upper portion thereof. A similar annular groove 127 is provided in the lower portion of cylinder 124. A passage 131' communicates between the interior and the exterior of housing 125 at a level thereof at which this passage always communicates with groove 127 regardless of the annular position of the cylinder 124 with respect to housing 125. In the same way passage 131'' communicates with groove 126 and the exterior of housing 125. In addition, housing 125 has an inlet port 131 and an outlet port 131''' both located at the same axial height of housing 125, but spaced apart from each other with respect to the circumference thereof. Cylinder 124 is provided with corresponding recesses 126*a* and 127*a* at the same level as ports 131''' and 131'''. Recesses 126*a*, 127*a* extend only over a limited arcuate length of the cylinder periphery so that in one position of cylinder 124 recess 127*a* can communicate with inlet port 131 whereas recess 126*a* communicates with outlet port 131''', and that in another, second position of cylinder 124 recess 127*a* communicates with outlet port 131''' and recess 126*a* with inlet port 131. Recesses 126*a*, 127*a* are furthermore connected permanently, regardless of the cylinder position, with annular grooves 126, 127 through peripheral channels 129, 128, respectively.

In the first position of cylinder 124 relative to housing 125, as shown in FIG. 6, fluid may be forced by pump 122 through conduit 130, inlet port 131, channel 128, annular groove 127, thence through conduit 119 into chamber 117 pushing piston 116 in direction of arrow Y. Simultaneously, fluid present in second chamber 118, when piston 116 is moved in direction Y, will escape through port-hole 118*a* and conduit 120, passage 131'', annular groove 126, channel 129, returning through recess 126*a*, outlet port 131''' and conduit 132 into container 123.

As explained above, when cylinder 124 is turned into its second position, recess 126*a* communicates with inlet port 131 whereas recess 127*a* is in communication with outlet port 131'''. Consequently, fluid forced into conduit 130 by pump 122 enters now channel 129, groove 126, passage 131'' and conduit 120, reaching second chamber 118, so that piston 116 is moved this time in direction Z. Fluid from chamber 117 then returns to container 123 through conduit 119, passage 131', groove 127, channel 128, and outlet port 131'''. It is apparent that by turning control cylinder 124 from its first into its second position the direction of fluid flow can be returned at will, roller 110 thereby being reciprocated.

At its bottom, cylinder 124 is coupled with a wheel 136 that can be turned by an electrical motor 135 or a similar driving means through a belt 136*a* partly extending around wheel 136, and a pulley 135*a* connected with motor 135. Block 137 represents a source of energy to feed motor 135, whereas block 138 is illustrative of an arrangement to control the energy source 137 according to a predetermined program as stored, for example, in a punched cards, a magnetic tape or the like. Changing the speed of the motor 135 and consequently the rotations per time unit of cylinder 124, likewise changes the frequency at which the direction of fluid flow through conduits 119 and 120 is reversed. This, in turn, varies the frequency of the axial reciprocation of roller 110. Increasing the motor speed increases the frequency of reciprocation of roller 110, whereas lowering the speed of motor 135 has the opposite effect on roller 110. Evidently this frequency control can easily occur at any desired rate while roller 110 is spinning about its longitudinal axis, with no interruption of the production process being required.

The new arrangement according to this invention likewise makes it possible to control the stroke or amplitude of the axial reciprocal movement of roller 110. This is easily accomplished by changing the speed at which pump 122 operates so that a lower or a higher amount of fluid is forced, per time unit, through conduit 130. Block 122*a* is representative of a resistor unit or a similar arrangement capable of changing the pump speed as desired. In case pump 122 is of a constant delivery type a suitable throttle valve 170 is provided to control the amount of fluid actually passing through conduit 130.

In the axially reciprocating driving means, a roller 110 may of course be replaced by a compression beam 16 through 20, 36 through 40, i.e. the compression beams may be mounted and reciprocated in the same manner. A device of this type is illustrated in FIG. 7 to be described hereinafter.

The rollers in the upper row 10 and in the lower row 30 as well as the compression beams may be provided with suitable heating devices. The hollow internal cavities of the compression beams are in this case provided with suitable heating devices or with connections for supplying a suitable heat transfer medium. Such a device will be described with reference to FIG. 9.

Figure 7:
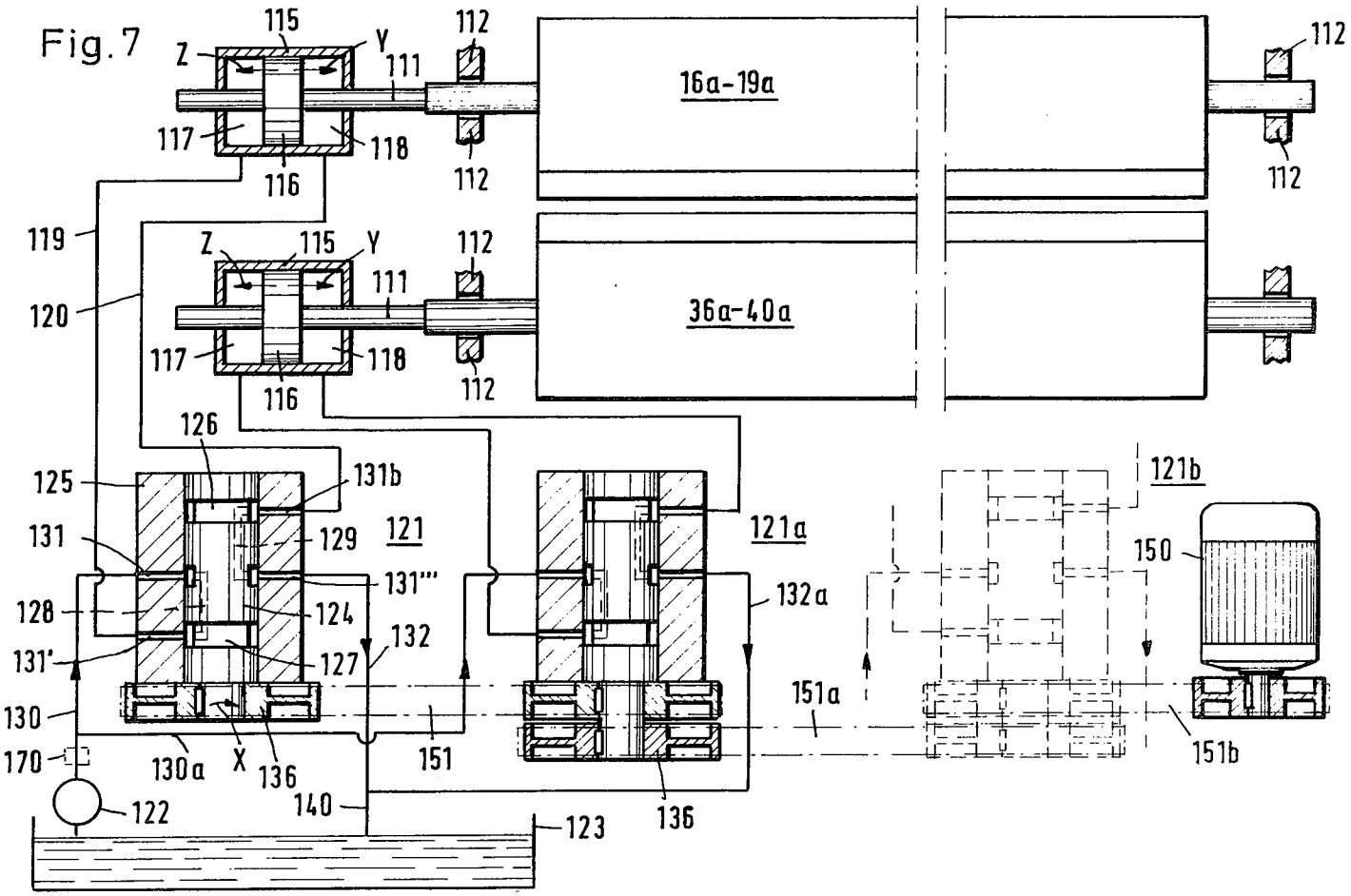
FIG. 7 is a schematic diagram with parts shown in section illustrating an arrangement including means for effecting reciprocating movement of compression beams.

In FIG. 7 there are shown two compression beams 16*a*, 36*a*. The compression beam 16*a* is associated with the upper row of rollers 10, and the compression beam 36*a* is associated with the lower row of rollers 30 of the apparatus. Both compression beams 16*a*, 36*a* are journalled in the same manner as the roller 110 shown in FIG. 6, and are connected to a control unit of the type shown in FIG. 6 for the roller 10.

With each compression beam 16*a*, 36*a* there is associated a control unit 121, 121*a*, respectively. If there are provided more than two driven compression beams, then a corresponding number of control units will be provided, as indicated schematically in dashed lines at 121*b*. The control means 121, 121*a* and 121*b*, respectively, are driven by a driving mechanism 150 through a belt drive 151, 151*a*, 151*b*. As shown in FIG. 7, the pressurized fluid for controlling the pistons 116 is supplied from the pressurized fluid reservoir 123 by the pump 122 and through the lines 130, 130*a* to the two control units 121, 121*a*. The pressurized fluid returns to the pressurized fluid reservoir 123 through a common line 140 that is connected to the two lines 132, 132*a*. The operation of the control units corresponds to the operation as described with respect to FIG. 6.

Figure 8:
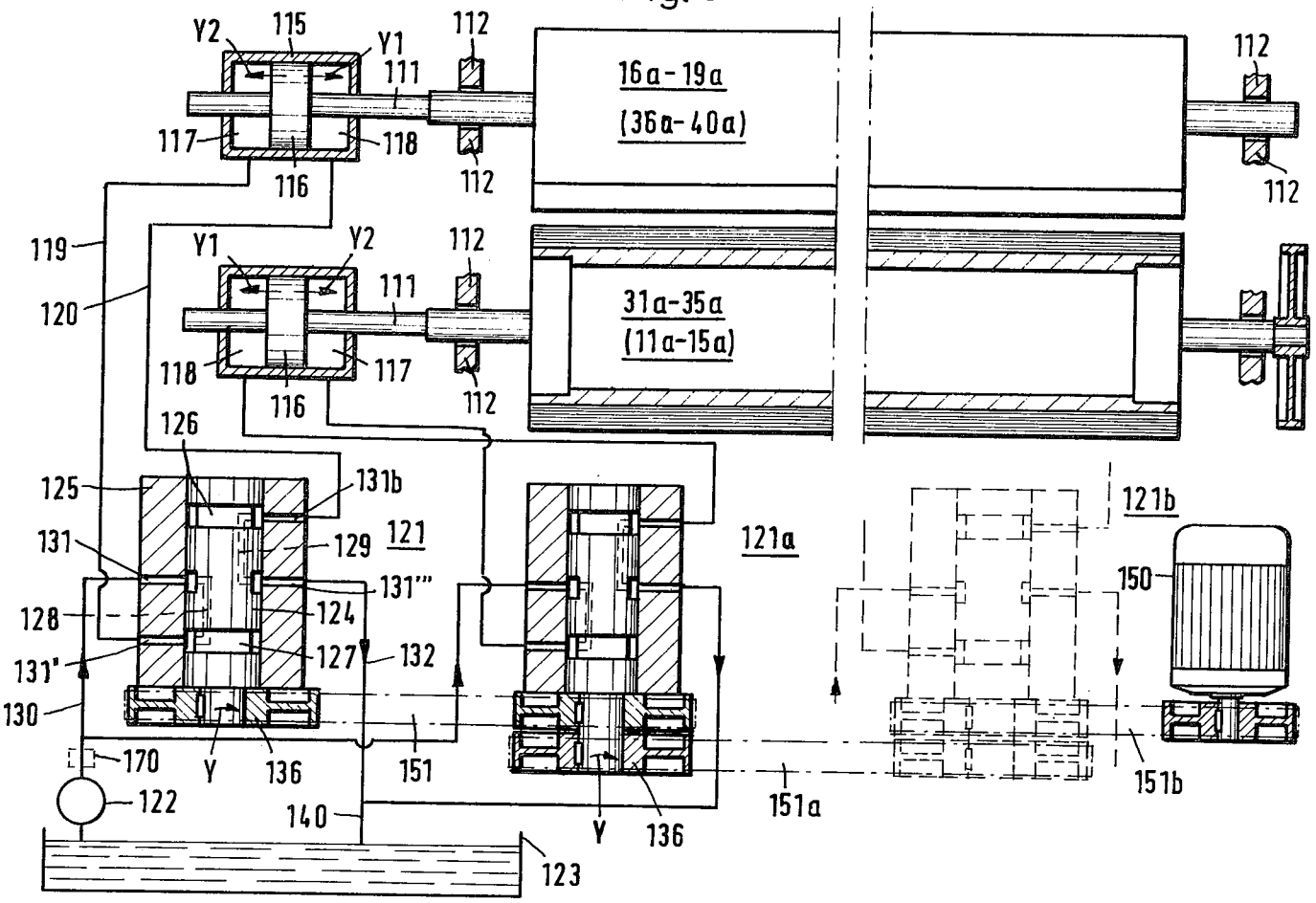
FIG. 8 is a schematic illustration of a compression beam and a roller with associated control units.

In FIG. 8, there is shown a compression beam and a roller with associated control units. Every compression beam 16*a* to 19*a*, or respectively 36*a* to 40*a*, and every roller 11*a* to 15*a*, or respectively, 31*a* to 35*a*, is connected to an associated control unit 121, 121*a*, 121*b* whereby the number of control units 121 corresponds to the number of compression beams and rollers. In FIG. 8, there are shown the control units 121, 121*a* associated with the compression beam 16*a* and the roller 31*a* for axially reciprocating the same. The control units for the other compression beams and rollers are not shown and are merely schematically indicated by the control unit 121*b* shown in dashed lines. The control means 121, 121*a* and 121*b* are driven by a driving motor 150 through a belt drive 151, 151*a*, 151*b*.

The two control units 121, 121*a* are identical, and their design and operation corresponds to the one shown in FIG. 6 and as described above. The sense of rotation of the individual control elements 126, 127 is indicated by the arrows *y*. The drive pulleys associated with these control elements 126, 127 are indicated at 136.

The movements of the pistons 116 connected with the compression beam 16*a* and the roller 31*a* are indicated by the arrows $y_1$, $y_2$. When moving, the piston 116 that is connected to the compression beam 16*a* by the control rod 111 in the direction of the arrow $y_1$, then concurrently the oppositely acting second control unit 121*a* moves the piston 116 that is connected to the roller 31*a* by the control rod 111 forwardly in the direction of the arrow $y_2$. When advancing the piston 116 with the compression beam 16*a* in the direction of the arrow $y_2$, the piston 116 connected to the roller 31*a* will be moved backwardly in the direction of the arrow $y_1$. By this reverse control the compression beams and the rollers reciprocate in opposite directions whereas in FIG. 7 the two compression beams 16*a*, 36*a* are axially reciprocated in the same directions by moving the pistons 116 jointly either in the direction of the arrow Z or in the direction of the arrow Y.

Figure 9:
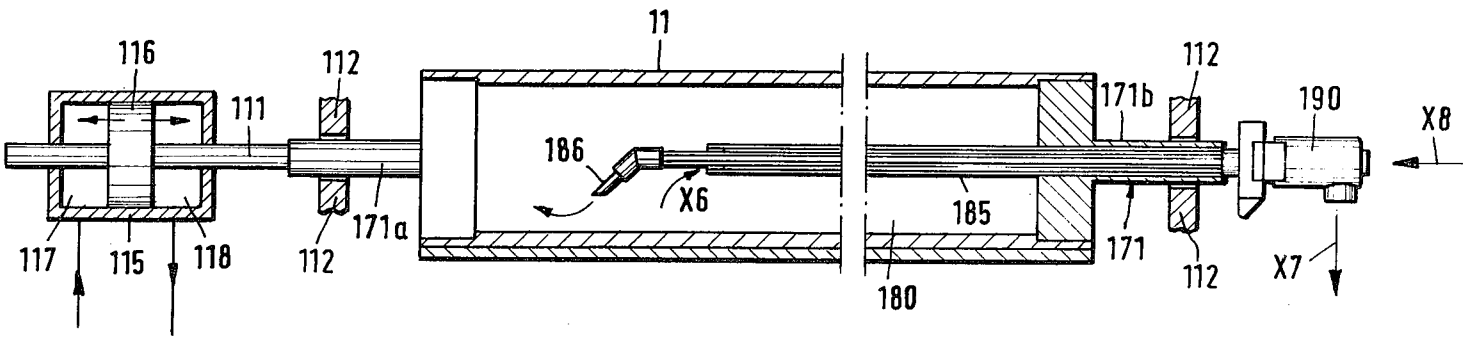
FIG. 9 is a view partly in elevation and partly in section illustrating a heated roller.

The aspect of the invention involving a heated roller is shown in FIG. 9. A shaft 171 connected to the roller 11 includes the shaft ends 171*a*, 171*b* that are journalled in bearings 112. The shaft end 171*a* is connected to the control piston 116 of the actuator cylinder 115 by the control rod 111. The other shaft end 171*b* is arranged as a hollow shaft. Through this hollow shaft extends a feed line 185 for supplying hot air, hot steam or the like for heating the roller into the inner space 180 of the roller 11 which, in this case, consists of a hollow cylinder. This feed line 185 consists of two coaxially arranged pipes whereby hot air entering the head 190 in the direction of the arrow $x_8$ will be discharged at the end 186 of the feed line 185 into the inner space 180 of the roller 11 and returns in the direction of the arrow $x_6$ through the annular space between the pipes and may be discharged at the head 190 in the direction of the arrow $x_7$.

The invention is of course not restricted to the embodiments as described above and illustrated in the drawings. The described and illustrated driving mechanism for the axial reciprocation of rollers and compression beams by variable amplitudes may of course be replaced by any other suitable driving means. The felting machine may comprise compression beams that are coupled to axial reciprocating means of variable amplitudes, or the compression beams may be mounted so as not to be movable in their longitudinal direction. Furthermore, it would be possible to design the felting apparatus so that only the compression beams may perform axial reciprocating movements whereas the rollers of the rows 10 and 30 cannot be axially reciprocated. The rollers in the upper row 10 need not be driven and may consist of idling rollers that are journalled in the machine frame 5. In this case, these upper rollers will be entrained by the advancing fleece V.

The felting operation which in heretofore known felting machines required a fairly extended run may be carried out in the felting apparatus of the present invention over a relatively short distance, at comparable satisfactory results. Because of the design of the felting apparatus, particularly the usage of compression beams between the rollers in the upper and lower rows of rollers, the felting apparatus may have minimum dimensions and may be constructed most economically. Additionally, the apparatus allows to manufacture felt materials of an increased thickness which is possible only to a limited extent with prior art roller felting machines. By suitably selecting the rotating speeds of the rollers, the felting apparatus may likewise be employed for the felting or matting of wool fibers.

What I claim is:

1. Apparatus particularly suitable for felting and fulling of felt materials comprising a plurality of rollers having a given length arranged in two mutually overlying rows of rollers, said rows defining therebetween a path through which a fleece may be passed in a given direction between said two rows of rollers, driving means for rotating said rollers, a compression beam located intermediate every two adjacent rollers in said two rows of rollers, said compression beam having a longitudinal extension corresponding substantially to said length of said rollers, with each of said compression beams having a side facing said path defined between said rows of rollers through which said fleece may be passed, means defining an arcuate surface on said side facing said path of each of said compression beams, said arcuate surface of each of said beams being curved on the side thereof facing toward said given direction of passage of said fleece with a generally convex configuration curving away from said path to define on one side of said path an entry aperture facing toward said given direction of passage of said fleece, and driving means coupled with said compression beams located in both said overlying rows of rollers for axially reciprocating said compression beams, said driving means operating to reciprocate said compression beams with variable predetermined amplitudes.

2. An apparatus according to claim 1, wherein every compression beam consists of a rectangular profile and includes a cantilevered portion with an arcuate surface at the side facing a fleece, the cantilevered portion projecting toward the entry side of the fleece.

3. An apparatus according to claim 1, wherein every compression beam consists of a hollow profile of a substantially rectangular cross-section with arcuately shaped concave side walls of a curvature mating the curvature of the cylindrical outer surface of the rollers, and arcuately shaped convex top and bottom walls.

4. Apparatus according to claim 1 wherein each of said rollers in one of said rows on one side of said path is arranged opposite a corresponding roller in the other of said rows on the opposite side of said path.

5. Apparatus according to claim 4 wherein each of said compression beams is arranged in one of said rows on one side of said path opposite a compression beam in the other of said rows on the opposite side of said path, with said entry apertures being defined between pairs of said arcuate surfaces.

6. Apparatus according to claim 1 wherein each of the rollers in one of said rows on one side of the path are laterally displaced with respect to each of the rollers in the other of said rows on the opposite side of said path.

7. Apparatus according to claim 6 wherein each of said rollers in one of said rows on one side of said path is arranged opposite a compression beam in the other of said rows on the opposite side of said path, with said entry apertures being defined between one of said arcuate surfaces and one of said rollers.

8. Apparatus according to claim 1 including means for axially reciprocating said rollers wherein the amplitude of this reciprocating movement may be altered.

9. Apparatus according to claim 1 including driving means for axially reciprocating said rollers by variable predetermined amplitudes, said driving means for axially reciprocating said compression beams being coupled to said driving means for axially reciprocating said rollers thereby to provide synchronous reciprocating movement of said rollers and said compression beams.

10. Apparatus according to claim 1 further comprising heating devices included in said compression beams.

11. Apparatus according to claim 1, further including springs biasing said compression beams and said rollers in the upper one of said two mutually overlying rows of rollers.

* * * * *